US008076560B2

(12) United States Patent
McKee

(10) Patent No.: US 8,076,560 B2
(45) Date of Patent: Dec. 13, 2011

(54) MUSICAL INSTRUMENT PICK GRIP

(75) Inventor: Christopher J. McKee, Eastpointe, MI (US)

(73) Assignee: C J Products LLC, Eastpointe, MI (US)

( * ) Notice: Subject to any disclaimer, the term of this patent is extended or adjusted under 35 U.S.C. 154(b) by 0 days.

(21) Appl. No.: 12/771,605

(22) Filed: Apr. 30, 2010

(65) Prior Publication Data

US 2011/0265630 A1 Nov. 3, 2011

(51) Int. Cl.
*G10D 3/16* (2006.01)

(52) U.S. Cl. ..... 84/320

(58) Field of Classification Search ..... 84/320–322, 84/315–317

See application file for complete search history.

(56) References Cited

U.S. PATENT DOCUMENTS

| | | | | |
|---|---|---|---|---|
| 7,145,066 | B1 | 12/2006 | Moreland | |
| 2001/0046559 | A1 | 11/2001 | Hewitson | |
| 2002/0043148 | A1 | 4/2002 | Wilkinson | |
| 2006/0196340 | A1 | 9/2006 | Storey | |
| 2008/0110319 | A1 * | 5/2008 | Morris | 84/320 |

* cited by examiner

*Primary Examiner* — Kimberly Lockett

(74) *Attorney, Agent, or Firm* — Harness, Dickey & Pierce, P.L.C.

(57) ABSTRACT

A grip member for connection to an instrument pick includes a grip member body having opposed first and second sides. A plurality of abrasive particles is attached to and extends away from the first side. An adhesive on the second side is used to adhesively connect the grip member to a pick surface. An aperture extends entirely through the grip member first and second sides such that the pick surface is exposed through the aperture when the grip member is adhesively connected to the pick surface permitting the user's finger to contact both the abrasive particles and the pick surface through the aperture.

20 Claims, 6 Drawing Sheets

MUSICAL INSTRUMENT PICK GRIP

FIELD

The present disclosure relates to picks used for playing stringed musical instruments.

BACKGROUND

This section provides background information related to the present disclosure which is not necessarily prior art.

Picks used during play of stringed musical instruments are commonly made of metal or plastic having smooth surfaces where the user grips the pick. This leads to twisting or displacement of the pick between the user's fingers during play, and can change the flexibility of the pick as the grip point changes and can lead to the user dropping the pick. Perspiration or other substances on the fingers can also reduce frictional contact with the pick. Modified picks include grip surfaces embossed or etched onto the pick surfaces. These modifications, however, often add thickness to the pick by adding a different material as ridges or beads, which can "deaden" the pick by reducing the feedback of the force and vibration of the strings which are felt by the user as feedback or spacing the user's fingers further away from the playing surface of the pick. Modifications to improve grip are also known which add one or more apertures to the pick. These designs do not maximize the grip force as the user's fingers may contact themselves through the apertures, and if perspiration is present the fingertips in contact can still rotate or allow the pick to rotate.

SUMMARY

This section provides a general summary of the disclosure, and is not a comprehensive disclosure of its full scope or all of its features.

According to several embodiments, a grip member for releasable connection to an object includes a grip member body having opposed first and second sides. A plurality of abrasive particles is attached to and extends away from the first side. An adhesive on the second side adhesively connects the grip member to an object surface. An aperture extends entirely through the grip member first and second sides. A geometry of the grip member is selected such that when the grip member is adhesively connected to the object surface using the adhesive, a first portion of a user's first finger contacts a portion of the abrasive particles and a second portion of the user's first finger directly contacts the object surface by extending through the aperture.

According to other embodiments, a grip member for connection to an instrument pick includes a grip member body having opposed first and second sides. A plurality of abrasive particles is attached to and extends away from the first side. An adhesive on the second side is used to adhesively connect the grip member to a pick surface. An aperture extends entirely through the grip member first and second sides such that the pick surface is exposed through the aperture when the grip member is adhesively connected to the pick surface According to further embodiments, a grip member pick assembly includes a pick having opposed first and second surfaces. A first grip member includes a grip member body having opposed first and second sides. A plurality of abrasive particles is attached to and extends away from the first side defining an abrasive surface. An adhesive coating the second side adhesively connects the grip member to the pick first surface. An aperture extends entirely through the grip member first and second sides such that the pick first surface is exposed through the aperture when the grip member is adhesively connected to the pick first surface. The aperture includes oppositely positioned first and second inner edges spaced to permit direct contact between a first portion of a user's first finger with both the first and second inner edges.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
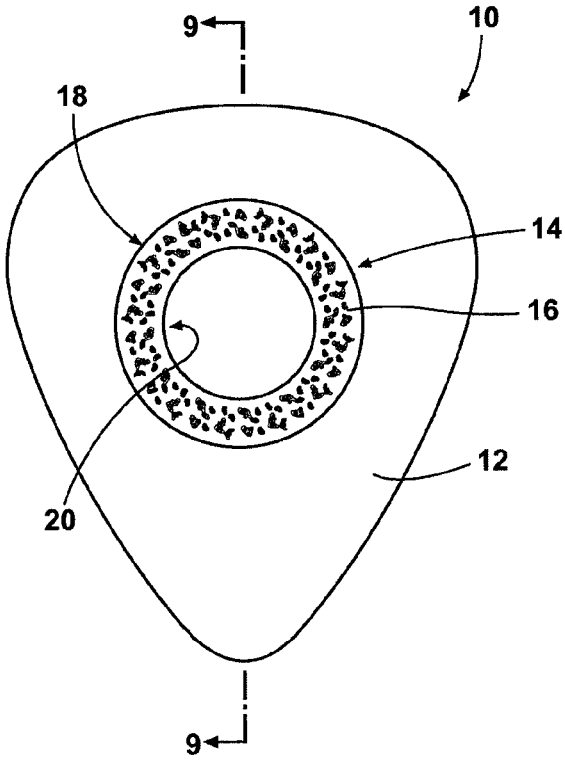
FIG. 1 is a top plan view of a pick assembly having grip members of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Figure 4:
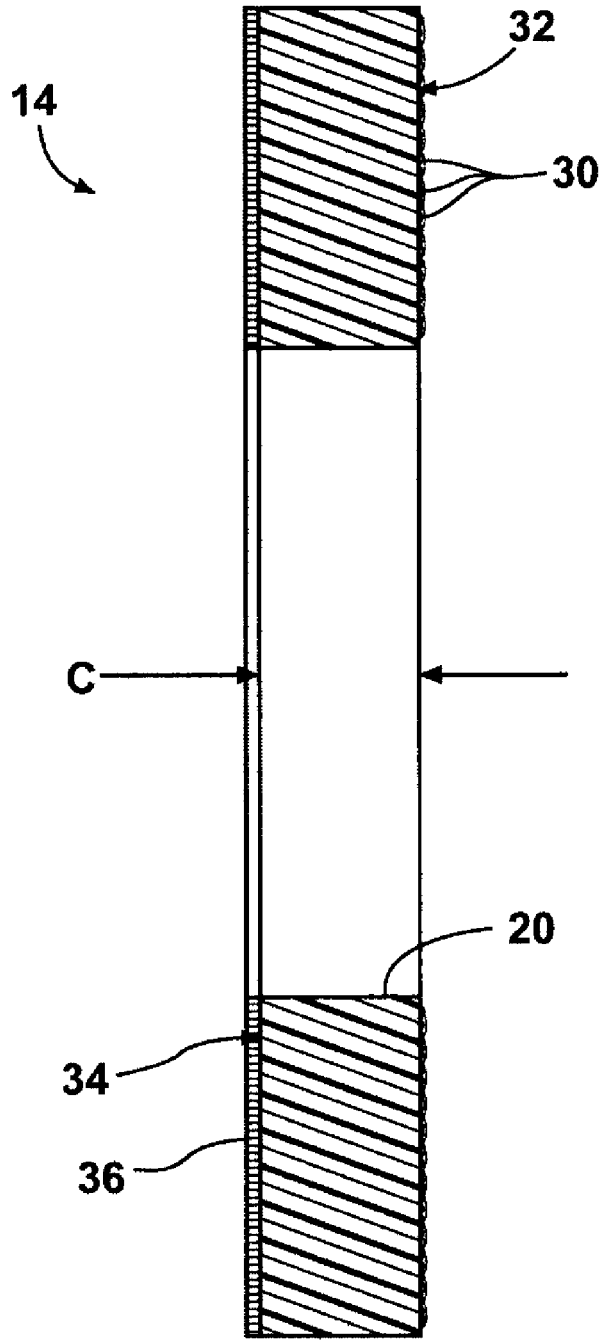
FIG. 4 is a cross sectional side elevational view taken at section 4 of FIG. 3.

Referring to FIG. 1, a pick assembly 10 includes a pick 12 having a grip member 14 connected thereto. Pick 12 can be selected from any of a plurality of commonly available musical instrument picks made from plastic or metal material and having any geometric shape. A common pick 12 having a generally triangular shape is depicted in FIG. 1. Grip member 14 can be either permanently or releasably attached to pick 12 as will be described in greater detail in reference to FIGS. 4 and 5. Grip member 14 can be created in substantially any geometric shape, and the circular shape shown in FIG. 1 is therefore provided as an example only. Grip member 14 includes an abrasive surface 16 bounded by an outer perimeter 18 and an inner aperture 20.

Figure 2:
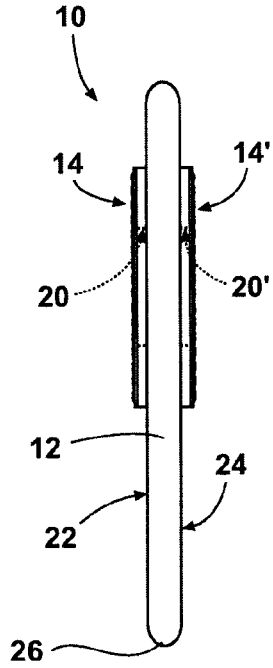
FIG. 2 is a right side elevational view of the pick assembly of FIG. 1.

Referring to FIG. 2, according to several embodiments, two grip members 14, 14' are oppositely mounted on pick 12 such that grip member 14 extends away from a pick first surface 22, and grip member 14' extends away from an oppositely directed pick second surface 24. According to several embodiments, grip members 14, 14' are positioned directly opposite of each other so that the apertures 20, 20' are coaxially aligned with each other. Grip members 14, 14' are also generally positioned away from an instrument contact end 26 to provide for maximum deflection of instrument contact end 26, for example when used in contacting the strings of a guitar (not shown).

Figure 3:
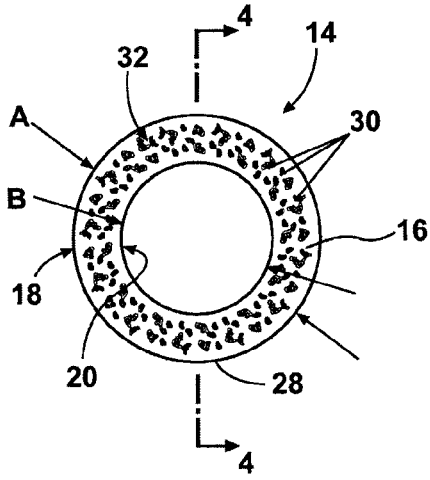
FIG. 3 is a top plan view of a grip member of the present disclosure.

Referring to FIG. 3 and again to FIG. 1, individual grip members 14 each include a perimeter wall 28 which is defined by the outer perimeter 18 shape. A plurality of abrasive particles 30 is permanently affixed to and extends outwardly away from a first side 32. According to several embodiments, grip members 14 can be made from pre-manufactured, grit-containing materials or products including but not limited to tread material such as 3M™ Tread-Walk™ tread material or other commonly available tread materials or adhesively backed sandpaper or grinding beltsI. The material of grip members 14 is elastically flexible to permit the grip member 14 to elastically flex together with the pick during instrument play.

Referring to FIG. 4 and again to FIG. 2, aperture 20 extends entirely through first and second sides 32, 34. Grip members 14 further include a smooth second side 34 oppositely directed with respect to first side 32. A pick thickness "C" is defined between first side 32 and second side 34. Abrasive particles 30 are affixed to and extend away from first side 32. Second side 34 includes a layer of adhesive 36 coating and according to several embodiments applied substantially over the entire second side 34. Adhesive 36 is used to either permanently or releasably adhesively connect grip members 14 to either or both first and second surfaces 22, 24 of pick 12.

The type of adhesive selected for adhesive 36 can be either a permanent or releasable adhesive. A permanent adhesive as defined herein is intended to permanently adhere grip members 14 to pick 12 such that use of a tool and/or damage to either the pick 12 and/or grip member 14 would be required to remove the grip member 14. A releasable adhesive as defined herein requires no tool use to remove, and grip members 14 can therefore be manually removed from pick 12 without damage to either pick 12 or grip member 14, such that the adhesive 36 is retained with grip member 14 for subsequent reapplication of grip member 14 to the same or a different pick 12.

Figure 5:
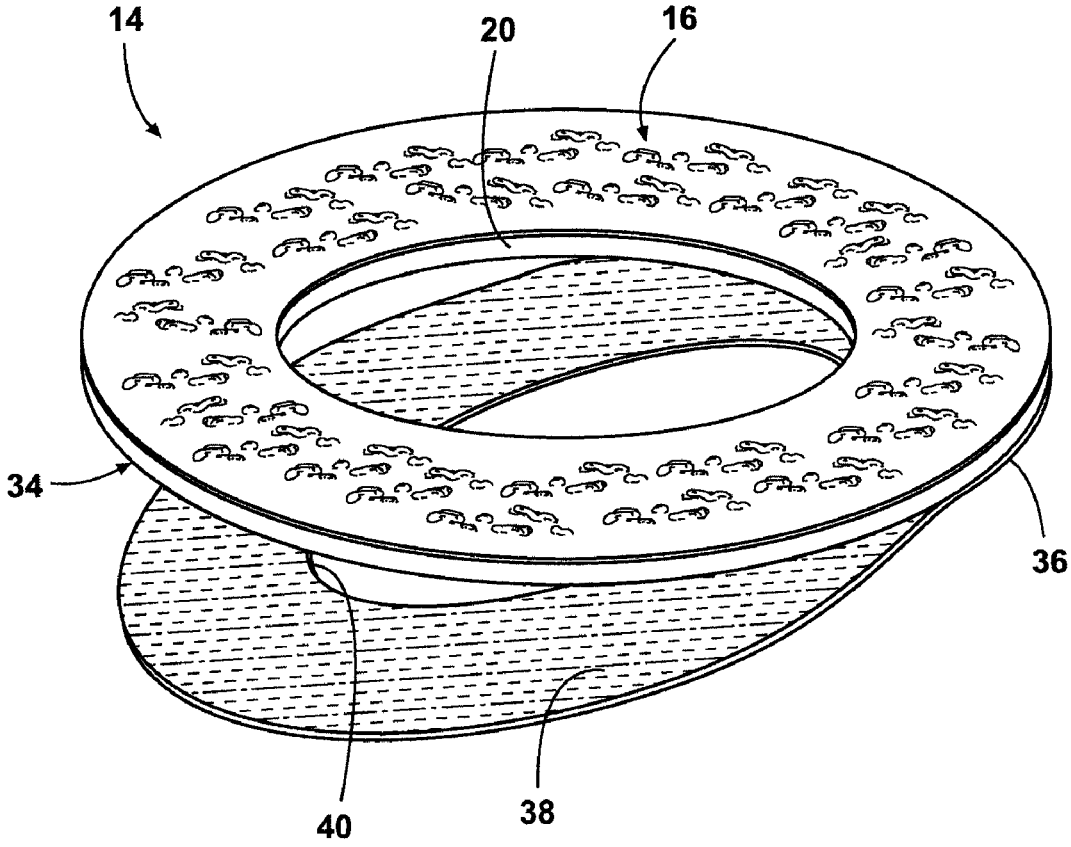
FIG. 5 is a front perspective view of the grip member of FIG. 3.

Referring to FIG. 5, the geometry of grip member 14 is created by an operation such as a cutting operation, a punch operation, a stamping operation, or the like. After the geometry of grip member 14 is created by the appropriate operation and grip member 14 is ready to be installed on the pick, a removable layer 38 is pulled away from adhesive 36 and second side 34, leaving the adhesive 36 in contact with second side 34. Removable layer 38 can be, for example, a paper or thin plastic film applied by the manufacturer of the material used for grip member 14. Removable layer 38 is intended to be retained with grip member 14 until the time of installation of grip member 14 such that adhesive 36 is not detrimentally effected by dirt, moisture, or the like, which could reduce the adhesive properties of adhesive 36. A cutout portion 40 is created in removable layer 38 at the same time as the creation of aperture 20. Cutout portion 40 therefore mimics the geometry of aperture 20.

Figure 6:
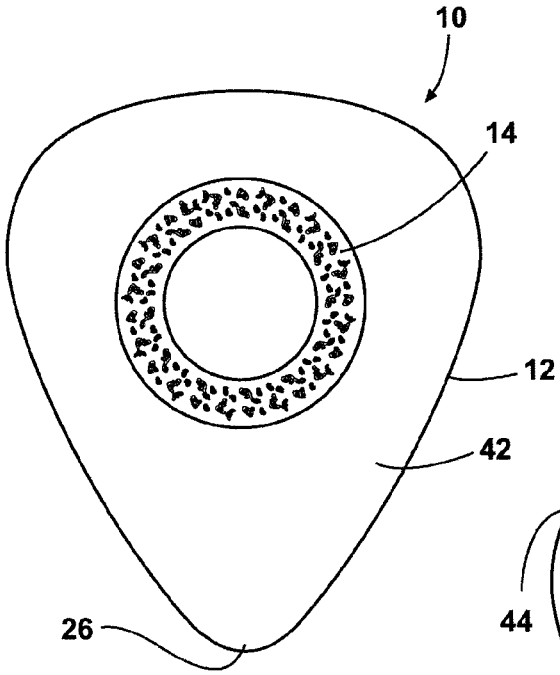
FIG. 6 is a top plan view similar to FIG. 1.

Referring to FIG. 6, according to several embodiments, pick assembly 10 provides for grip member 14 to be adhesively applied to a grip portion 42. Grip member 14 can be applied at any location on grip portion 42. According to several embodiments, grip member 14 is centered in grip portion 42 and spaced away from instrument contact end 26 of pick 12 to maximize the flexure of instrument contact end 26. This centralized location of grip member 14 provides a broad range of contact areas for the user of pick 12 to contact all the surface areas and edges of grip member 14 in use.

Figure 7:
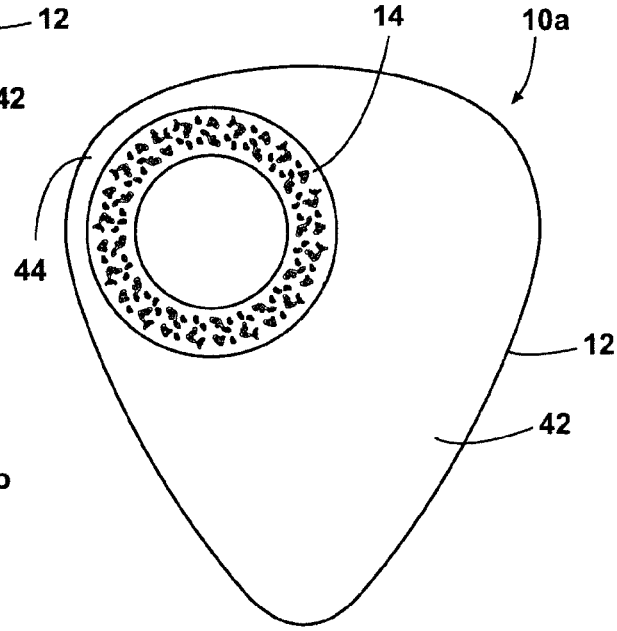
FIG. 7 is a top plan view modified from FIG. 6 to show an alternate location of the grip member.

Referring to FIG. 7, it is also possible for grip members 14 to be applied in substantially any location on the surface of pick 12. In the example shown in FIG. 7, grip member 14 is applied at or near a border region 44 of grip portion 42 while still being spaced away from instrument contact end 26.

Figure 8:
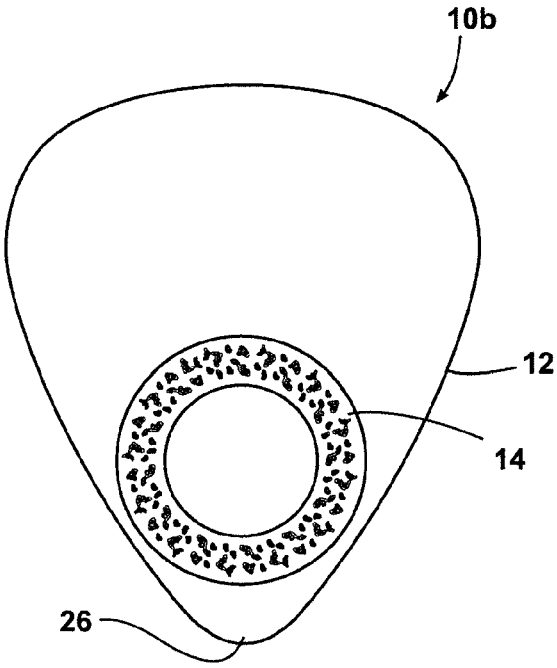
FIG. 8 is a top plan view modified from FIG. 6 to show another alternate location of the grip member.

Referring to FIG. 8, at the discretion of the user, grip member 14 can also be applied at or close to instrument contact end 26. This location of grip member 14 can provide a contact area for the fingers of the user in close proximity to instrument contact end 26, therefore providing for limited or no deflection of instrument contact end 26 during play.

Figure 9:
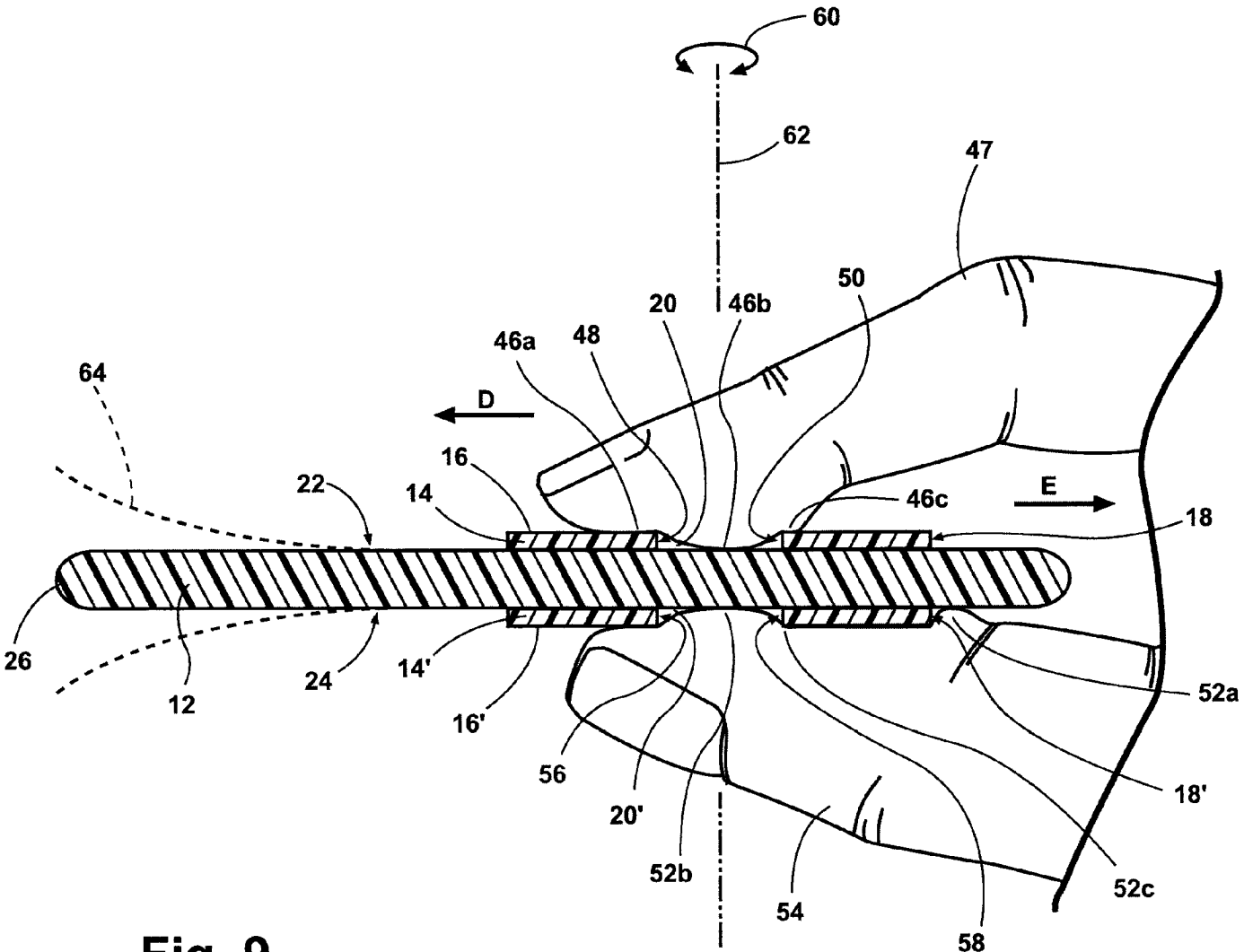
FIG. 9 is a cross sectional side elevational view taken at section 9 of FIG. 1.

Referring to FIG. 9, with grip members 14, 14' applied to first and second surfaces 22, 24 of pick 12, an exemplary contact between a first portion 46*a* of a first finger 47 of a user can cover all or a portion of abrasive surface 16 and a second portion 46*b* of first finger 47 can extend into aperture 20 to directly contact first surface 22 of pick 12. Additional gripping surface is provided by a third portion 46*c* of first finger 47 positioned within aperture 20 in direct contact with at least one of opposed first and second inner edges 48, 50. Third portion 46*c* can also provide contact with the perimeter defined by the entire aperture diameter at the inner edge of aperture 20. In addition, depending on the geometry of grip member 14, first portion 46*a* of first finger 47 can further overlap and contact a portion of or all of outer perimeter 18 of grip member 14.

In addition to the contact provided by the first, second, and third portions 46*a*, 46*b*, 46*c* of first finger 47, additional contact can be provided by first, second, and third portions 52*a*, 52*b*, 52*c* of a second finger 54, which can be the user's thumb, such that first portion 52*a* contacts some or all of abrasive surface 16', second portion 52*b* directly contacts second surface 24 within aperture 20', and third portion 52*c* directly contacts at least one of opposed third and fourth inner edges 56, 58 of aperture 20' of grip member 14'. Second finger 54 is also shown overlapping and, therefore, contacting outer perimeter 18' of grip member 14'.

By providing apertures 20, 20' in each of the grip members 14, 14', pick 12 and, therefore, grip members 14, 14' can be rotated about a rotational direction 60 with respect to a central axis 62 defined through apertures 20, 20'. This permits the initial orientation of instrument contact end 26 to be determined and substantially fixed by insertion of portions 46*b*, 52*b* of first and second fingers 47, 54 into apertures 20, 20' and by contact of portions 46*a* and 52*a* of first and second fingers 47, 54 with the abrasive surfaces 16, 16'. This contact of the first finger 47 and second finger 54 effectively precludes a sliding motion of pick 12 in either a contact end direction "D" or a grip portion direction "E" once the pick 12 has been gripped as shown. By appropriate sizing and geometry selection of grip members 14, 14', the entire abrasive surface 16, 16' of the grip members 14, 14' can be contacted by the user's fingers, if desired.

With further reference to FIG. 9, and as previously noted herein, a bending arc 64 at instrument contact end 26 can be changed by the positioning of grip members 14, 14' with respect to a distance between central axis 62 and instrument contact end 26. For example, moving grip members 14, 14' in the contact end direction "D" will generally reduce bending arc 64, and moving grip members 14, 14' in the opposite grip portion direction "E" will move central axis 62 further away from instrument contact end 26, therefore increasing the degree or displacement of bending arc 64. Direct contact between first finger 47 with first surface 22 and between second finger 54 and second surface 24 of pick 12 provides for direct feedback of the contact force and string vibration between pick 12 and the musical instrument strings which could be dampened without the use of apertures 20, 20'.

Figure 10:
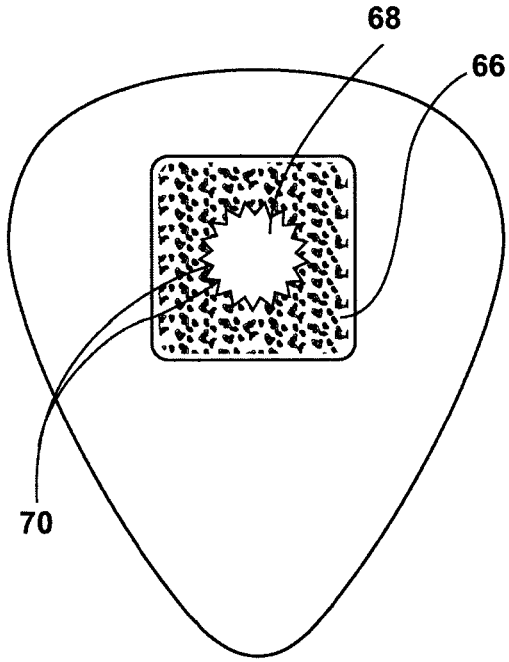
FIG. 10 is a top plan view of a rectangular shaped grip member of the present disclosure positioned on a pick.
Figure 11:
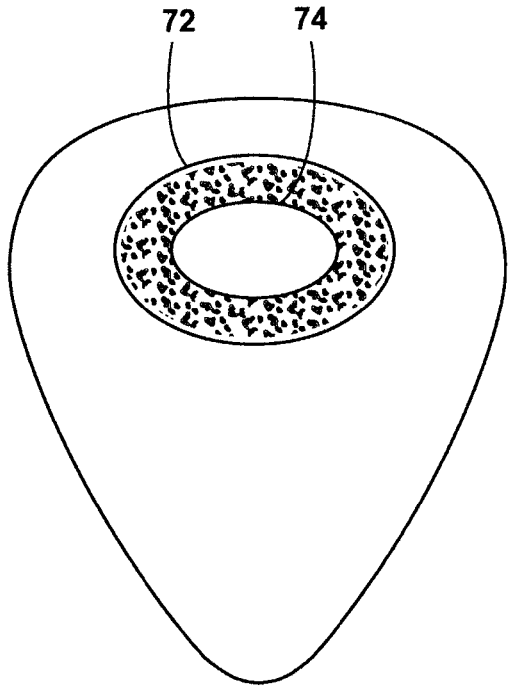
FIG. 11 is a top plan view of an oval shaped grip member of the present disclosure positioned on a pick.
Figure 12:
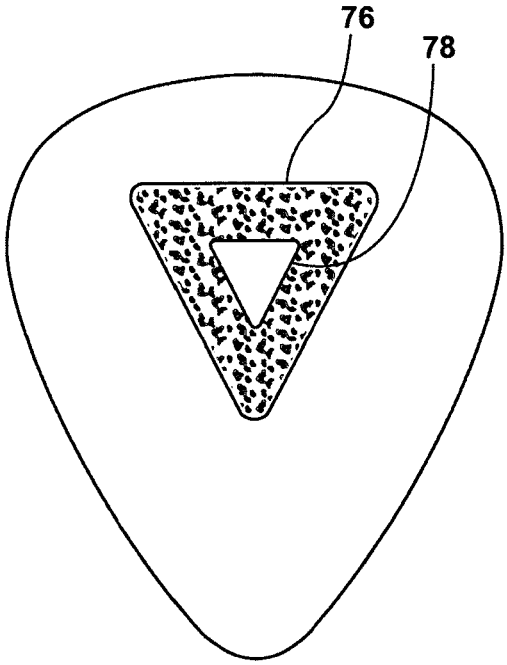
FIG. 12 is a top plan view of a triangular shaped grip member of the present disclosure positioned on a pick.

Referring to FIGS. 10-12, additional embodiments for grip members of the present disclosure can include a rectangular shaped grip member 66 having an aperture 68 including a plurality of extending fingers defining a serrated edge 70. Serrated edge 70 can further enhance the amount of contact between the fingers of the user and rectangular grip member 66. With specific reference to FIG. 11, an oval grip member 72 can include an oval aperture 74 providing an increased perimeter length of the inner wall defined by oval aperture 74. The orientation of oval grip member 72 or of rectangular grip member 66 can be reoriented from the positions shown at the discretion of the user. With specific reference to FIG. 12, a triangular grip member 76 can include a triangular aperture 78, further increasing the inner wall length of triangular aperture 78 compared to apertures 20 of grip members 14. FIGS. 10-12 represent exemplary embodiments of additional shapes for grip members of the present disclosure, but these shapes are not limiting and can be modified from those shown. Also, any shape can be used for the aperture created through grip members of the present disclosure independent of the outer or perimeter shape of the grip member.

Referring again to FIGS. 4 and 5, adhesive 36 according to several embodiments is a releasable adhesive which permits the positioning and placement of grip members of the present disclosure at any location on a pick at the discretion of the user. By use of a releasable adhesive 36, the grip members can be removed and relocated, or removed and reused on different picks, at the discretion of the user. The use of a permanent adhesive for adhesive 36 can also be provided. A permanent adhesive could be used, for example, where removal of the grip member is not desired.

Grip members of the present disclosure offer several advantages. By providing an abrasive surface having an aperture within the outer perimeter of the grip member, the user's fingers can, at the same time, directly contact both the abrasive surface as well as the surface of the pick. This increases the surface area of contact between the fingers and the pick, which resists a twisting motion of the pick between the fingers of the user. The apertures provided within the grip members of the present disclosure also provide for direct contact between the fingers of the user and the pick, which provides for direct feedback of the force and vibrations imparted to the strings of the instrument during play. Grip members of the present disclosure can also be releasable and therefore movable to any location on the pick surface desired by the user, or completely removed to be reused on a different pick. The releasable adhesive used does not leave an adhesive residue on the pick surface when pick member 14 is removed. Although opposed grip members of the present disclosure are shown and described herein, a single grip member of the present disclosure can also be used at the discretion of the user and still provide similar benefits of increased contact with the pick as well as direct feedback through the pick to the user.

Abrasive surface 16 including the plurality of individual abrasive particles 30 in random positions on the surface 32 permit frictional contact to be maintained even if perspiration or other substances are present on the user's fingers. Contact with the plurality of abrasive particles 30 provides resistance to mitigate against the pick twisting in the user's grip or loss of contact causing the pick to drop from the user's grip. Abrasive particles 30 are also selected to be substantially wear resistant when used in contact with a user's fingers.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A grip member for releasable connection to an object, comprising:

a grip member body having opposed first and second sides;

a plurality of abrasive particles attached to and extending away from the first side;

an adhesive on the second side used to adhesively connect the grip member to an object surface; and an aperture extending entirely through the grip member first and second sides; and a geometry of the grip member selected such that when the grip member is adhesively connected to the object surface using the adhesive, a first portion of a user's first finger contacts a portion of the abrasive particles and a second portion of the user's first finger directly contacts the object surface by extending through the aperture.

2. The grip member of claim 1, wherein the object comprises an instrument pick having the object surface defining a first pick surface.

3. The grip member of claim 1, wherein a second grip member is applied to a second pick surface having axes of the apertures coaxially aligned such that the second pick surface is contacted by a portion of a second finger directly opposite the first portion of the first finger.

4. The grip member of claim 1, wherein a second grip member is applied to a second pick surface having axes of the apertures of the first and second grip members coaxially aligned such that a first portion of a second finger contacts a portion of the abrasive particles of the second grip member and a second portion of the user's second finger directly contacts the second pick surface by extending through the aperture of the second pick member.

5. The grip member of claim 1, wherein the aperture includes a first inner edge and a second inner edge oppositely positioned with respect to each other and spaced to permit contact between the second portion of the user's first finger with both the first and second inner edges.

6. The grip member of claim 1, wherein the grip member body includes a perimeter wall positioned proximate to the aperture permitting the user's first finger to contact with the perimeter wall, the abrasive particles, and the object surface when the grip member body is adhesively connected to the object surface.

7. The grip member of claim 1, wherein the adhesive comprises a releasable adhesive permitting non-tool manual removal and re-use of the grip member.

8. A grip member for connection to an instrument pick, comprising:

a grip member body having opposed first and second sides;

a plurality of abrasive particles attached to and extending away from the first side;

an adhesive coating the second side used to adhesively connect the grip member to a pick surface; and an aperture extending entirely through the grip member first and second sides such that the pick surface is exposed through the aperture when the grip member is adhesively connected to the pick surface.

9. The grip member of claim 8, wherein a geometry of the grip member is selected such that when the grip member is adhesively connected to the pick surface using the adhesive, a first portion of a user's finger contacts a portion of the abrasive particles and a second portion of the user's finger directly contacts the pick surface by extending through the aperture.

10. The grip member of claim 8, wherein the adhesive is a releasable adhesive allowing user non-tool removal of the grip member from the pick surface.

11. The grip member of claim 8, wherein the grip member is substantially circular with the aperture defining a circular aperture.

12. The grip member of claim 8, wherein the grip member has a geometric outer perimeter and the aperture has a serrated shape.

13. The grip member of claim 8, wherein the grip member includes a removable layer covering the adhesive, the removable layer removed for application of the grip member to the pick.

14. The grip member of claim 8, wherein a shape of the aperture matches a shape of the grip member.

15. A grip member pick assembly, comprising:

a pick having first and second surfaces; and a first grip member including:

a grip member body having first and second sides;

a plurality of abrasive particles defining an abrasive surface attached to and extending away from the first side;

an adhesive coating the second side used to adhesively connect the grip member to the pick first surface; and an aperture extending entirely through the grip member first and second sides such that the pick first surface is exposed through the aperture when the grip member is adhesively connected to the pick first surface, the aperture including oppositely positioned first and second inner edges spaced to permit direct contact between a first portion of a user's first finger with both the first and second inner edges.

16. The grip member pick assembly of claim 15, comprising a second grip member substantially identical to the first grip member adhesively connected to the pick second surface.

17. The grip member pick assembly of claim 16, wherein axes of the apertures of the first and second grip members are coaxially aligned and the first and second inner edges of the aperture of the second grip member are spaced to permit direct contact between a first portion of a user's second finger with both the first and second inner edges of the second aperture.

18. The grip member pick assembly of claim 17, wherein a geometry of the second grip member permits a second portion of the user's second finger to contact a portion of the abrasive particles of the second grip member and a third portion of the user's second finger to directly contact the pick second surface by extending through the aperture of the second grip member.

19. The grip member pick assembly of claim 16, wherein a material of the first and second grip members is elastically flexible to permit the first and second grip members to elastically flex during flexure of the pick.

20. The grip member pick assembly of claim 15, wherein a geometry of the first grip member permits a second portion of the user's first finger to contact a portion of the abrasive particles and a third portion of the user's first finger to directly contact the pick first surface by extending through the aperture.

* * * * *